US007191484B2

(12) United States Patent
Dawe

(10) Patent No.: US 7,191,484 B2
(45) **Date of Patent: *Mar. 20, 2007**

(54) LAUNDRY APPLIANCE

(75) Inventor: Roger Michael Dawe, Chippenham (GB)

(73) Assignee: Dyson Technology Limited, Wiltshire (GB)

( * ) Notice: Subject to any disclaimer, the term of this patent is extended or adjusted under 35 U.S.C. 154(b) by 426 days.

This patent is subject to a terminal disclaimer.

(21) Appl. No.: 10/221,754

(22) PCT Filed: Feb. 27, 2001

(86) PCT No.: PCT/GB01/00826

§ 371 (c)(1),
(2), (4) Date: Sep. 16, 2002

(87) PCT Pub. No.: WO01/71085

PCT Pub. Date: Sep. 27, 2001

(65) Prior Publication Data

US 2003/0029205 A1 Feb. 13, 2003

(30) Foreign Application Priority Data

Mar. 18, 2000 (GB) ..... 0006502.9

(51) Int. Cl.
*D06F 33/02* (2006.01)

(52) U.S. Cl. ..... 8/158; 68/12.06; 68/23.1; 68/24

(58) Field of Classification Search ..... 8/158–159; 68/12.06, 23.1, 24, 131
See application file for complete search history.

(56) References Cited

U.S. PATENT DOCUMENTS 5,038,586 A * 8/1991 Nukaga et al. ..... 68/12.01
5,543,698 A 8/1996 Tao et al.
6,311,527 B1 * 11/2001 Monteiro et al. ..... 68/140
6,381,790 B2 * 5/2002 Monteiro et al. ..... 8/158
6,418,581 B1 * 7/2002 Bruce et al. ..... 8/159

FOREIGN PATENT DOCUMENTS

DE 89 05 566.7 8/1989

(Continued)

OTHER PUBLICATIONS

"Dyson to shift manufacturing operations to Asia"; Mark Tran; Feb. 5, 2002; Guardian Unlimited; pp. 1-3 of internet publication.*

*Primary Examiner*—Joseph L. Perrin
(74) *Attorney, Agent, or Firm*—Morrison & Foerster LLP

(57) ABSTRACT

A laundry appliance comprises a drum for receiving a load of articles. The drum comprises at least two rotatable drum portions and a drive which is capable of rotating the drum so as to cause relative rotation between the drum portions. A controller monitors and controls operation of the appliance. The controller is arranged to determine when there is an overload condition on the drive during a period when the drum portions are being rotated relatively to one another and, in the event of an overload condition, causes the drive to operate in a manner that alleviates the overload condition. The drive can abort the current drum action and begin the next drum action in the sequence and, after a predetermined number of overload conditions, can suspend counter-rotating drum operation. The user may be provided with an indication when an overload condition occurs.

11 Claims, 4 Drawing Sheets

FOREIGN PATENT DOCUMENTS

| | | |
|---|---|---|
| EP | 0 090 716 A1 | 10/1983 |
| EP | 0 091 336 A1 | 10/1983 |
| EP | 0 969 133 A1 | 1/2000 |
| GB | 2 244 149 A | 11/1991 |
| GB | 2 322 141 A | 8/1998 |
| GB | 2 337 274 A | 11/1999 |
| JP | 2000-254385 | 9/2000 |
| WO | 99/58753 | 11/1999 |

* cited by examiner

LAUNDRY APPLIANCE

FIELD OF THE INVENTION

The present invention relates to a laundry appliance such as a washing machine or washer-dryer.

BACKGROUND OF THE INVENTION

Conventional washing machines operate by agitating textile articles within a rotating drum in the presence of water and detergent so that dirt is released from the fibres of the textile articles into the water. The agitation is caused, in the case of front-loading washing machines, by the rotation of the drum about a generally horizontal axis so that the textile articles tumble over one another and rub against each other and against the walls of the drum. However, the rotational speed of the drum is limited because, if the speed is too high, the textile articles will merely be pressed under centrifugal forces against the interior walls of the drum. The articles then rotate with the drum and no agitation with respect to the drum or with respect to other articles is achieved. The amount of agitation which can be applied to the textile articles by front-loading washing machines is therefore limited. This means that, in order to achieve a specific standard of cleanliness, the machine must operate for a minimum period of time.

International Patent Application WO99/58753 describes a washing machine in which the drum comprises two rotatable portions which are driven in such a way that relative rotation is produced between the portions. The relative rotation between the rotatable portions gives a more vigorous agitation of the articles within the drum, treating them more intensively than they would be in conventional apparatus and consequently dirt is released from the textile articles at a higher rate than in other machines.

Users of conventional washing machines may sometimes overfill the drums of their machines with textiles beyond the manufacturer's recommended load rating. While this is undesirable, since it places an increased demand on the motor which drives the drum, it is generally tolerable. However, it has been found that a machine of the type described in WO99/58753 operates at its best when the volume of the load within the drum is below a certain limit and when the load within the drum does not contain rigid objects.

SUMMARY OF THE INVENTION

The present invention seeks to provide an improved laundry apparatus.

Accordingly, a first aspect of the invention provides a laundry appliance comprising a drum for receiving a load of articles to be laundered, the drum comprising at least two rotatable drum portions and a drive capable of rotating the drum so as to cause relative rotation between the adjacent rotatable drum portions, and a controller for monitoring and controlling operation of the appliance, the controller being arranged to cause the drive to rotate the drum portions relative to one another for a period of time, to determine when there is an overload condition on the drive during this period and, in the event of an overload condition, to cause the drive to operate in a manner that alleviates the overload condition.

This has the advantage that the machine prevents any damage to itself, or to the load within the drum, even if a user has overloaded the drum of the machine or has placed inappropriate articles within the drum, such as long, rigid articles (e.g. reinforcing ribs in a rucksack).

The portions of the drum can be rotated in opposite directions at the same or different speeds. Alternatively, each of the portions of the drum can be rotated at a different speed in the same direction.

Preferably, the controller is arranged to issue feedback to a user of the appliance via a user interface on the appliance, when an overload condition occurs. This feedback indicates that an overload condition occurred and that wash performance has been affected. This helps to educate the user for future occasions.

Other aspects of the invention provide a controller for the laundry appliance and a method of operating the appliance.

BRIEF DESCRIPTION OF THE DRAWINGS

Embodiments of the invention will now be described with reference to the accompanying drawings, in which.

DETAILED DESCRIPTION OF THE INVENTION

Figure 1:
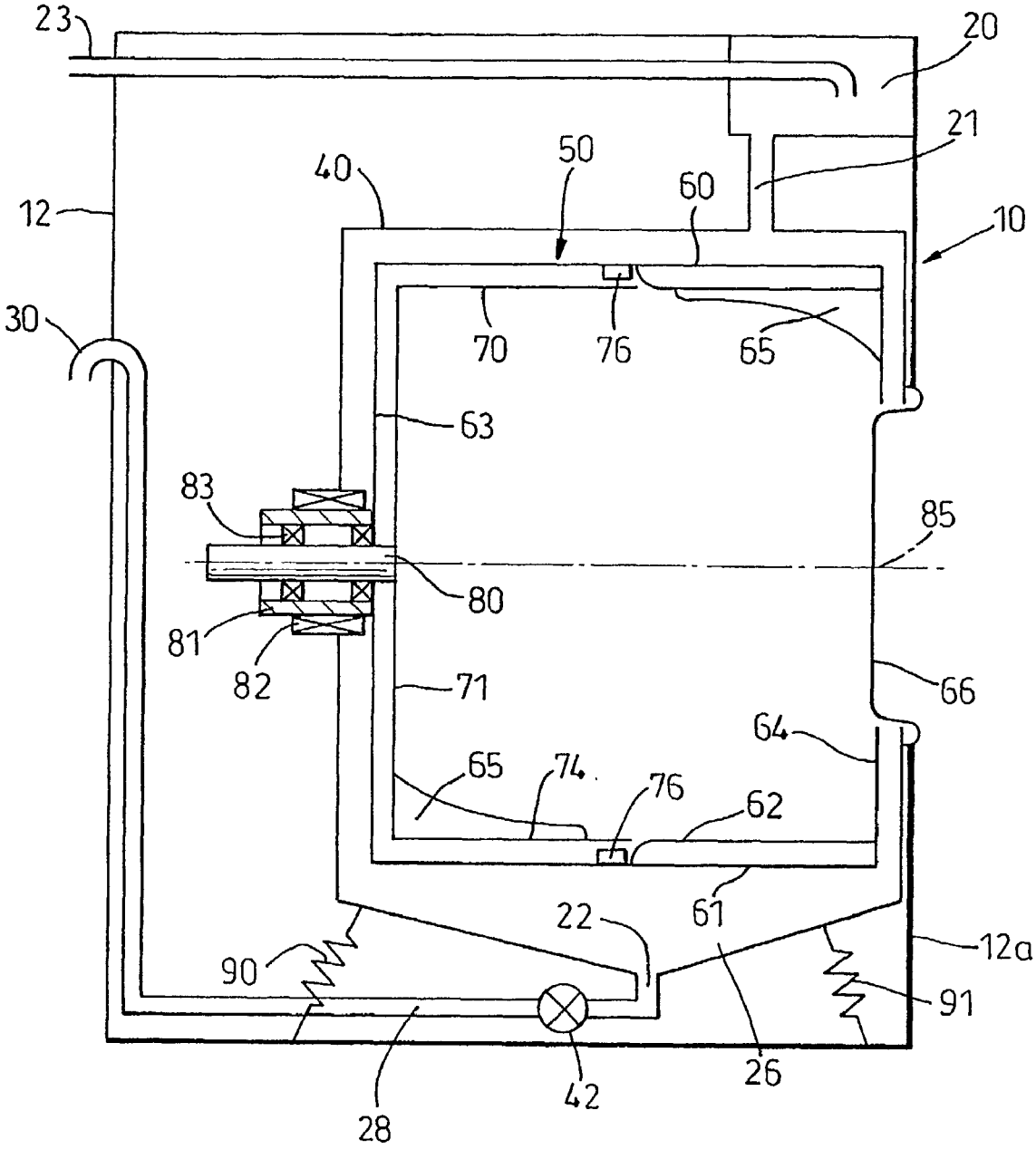
FIG. 1 is a cross-sectional view of a washing machine embodying the present invention.

FIG. 1 shows a washing machine 10 which includes an outer casing 12 in which a stationary tub 40 is located. A drum 50 is mounted inside the tub 40 so as to be rotatable about an axis 85. The tub 40 is watertight except for an inlet 21 and outlet 22. The washing machine 10 includes a soap tray 20 capable of receiving detergent in a known manner. At least one water inlet 23 communicates with the soap tray 20 and is provided with suitable means for connection to a water supply within the environment in which the washing machine 10 is to be used. A conduit 21 is provided between the soap tray 20 and the tub 40 so as to allow water introduced via the inlet 23 to enter the tub 40. The tub 40 has a sump 26 located beneath the drum 50. A drainage pipe 28 communicates with the sump 26 and leads to a water outlet 30 via which water can be discharged from the washing machine 10. A pump 42 is provided to allow water to be pumped from the sump 26 to the water outlet 30 at appropriate stages of the washing cycle carried out by the washing machine 10.

The drum 50 is rotatably mounted about the axis 80 by way of a shaft 80. The shaft 80 is mounted in a known manner, allowing the tub 40 to remain stationary whilst the drum 50 is rotatable with the shaft 80. The shaft 80 is rotatably driven by a motor (not shown) mounted within the outer casing 12 of the washing machine 10. A door 66 is located in the front panel 12*a* of the outer casing 12 to allow access to the interior of the drum 50. It is via the door 66 that a wash load can be deposited within the drum 50 before a wash cycle commences and removed from the drum 50 at the end of the wash cycle.

Drum 50 comprises two portions 60, 70 which are mounted such that they can be rotated with respect to one another. A drum of this type is described more fully in International Patent Application WO99/58753. Typically the drum portions 60, 70 are rotated in opposite directions to one another, i.e. one portion clockwise, one counter-clockwise, but they can also be rotated together in the same direction. The drum 50 is mounted in a cantilever fashion on the wall of the tub 40 remote from the door 66. The first outer rotatable portion 60, is supported on a hollow cylindrical shaft 81. An angular contact bearing 82 is located between the rear wall of the tub 40 and the hollow cylindrical shaft 81. The outer rotatable portion 60 is dimensioned so as to substantially fill the interior of the tub 40. More specifically, the outer rotatable portion 60 has a generally circular rear wall 63 extending from the hollow cylindrical shaft 81 towards the cylindrical wall of the tub 40, a generally cylindrical wall 564 extending generally parallel to the cylindrical walls of the tub 40 from the rear wall 63 towards the front wall of the tub 40, and a generally annular front face 64 extending from the cylindrical wall 61 towards the door 66. Sufficient clearance is allowed between the walls 61, 63, 64 of the outer rotatable portion 60 and the tub 40 to prevent the outer rotatable portion 60 from coming into contact with the tub 40 when the drum 50 is made to spin.

An inner cylindrical wall 62 is also provided on the interior of the cylindrical wall 61 of the outer rotatable portion 60. The inner cylindrical wall 62 extends from a point which is substantially midway between the rear wall 63 and the front face 64 to the front face 565. The space between the interior cylindrical wall 62 and the cylindrical wall 61 is hollow but, if desired, could be filled with a strengthening material. In this event, the strengthening material must be lightweight. The provision of parallel cylindrical walls 61, 62 in the portion of the outer rotatable portion 60 closest to the front face 64 provides strength to the whole of the outer rotatable portion 60 whilst reducing the internal diameter of the outer rotatable portion 60 in this region.

The inner rotatable portion 70 is supported on a central shaft 80, which in turn, is supported by deep groove bearings 83 located between the central shaft 80 and the hollow cylindrical shaft 81. The inner rotatable portion 70 essentially comprises a generally circular rear wall 71 extending from the central shaft 80 towards the cylindrical wall of the tub 40, and a cylindrical wall 74 extending from the periphery of the rear wall 71 towards the front wall of the tub 40. The diameter of the cylindrical wall 74 of the inner rotatable portion 70 is substantially the same as the diameter of the inner cylindrical wall 62 of the outer rotatable portion 60. The cylindrical wall 74 of the inner rotatable portion 70 is dimensioned so that its distal end approaches the end of the cylindrical wall 62 closest to it. It is advantageous to keep the gap between these two cylindrical walls 62, 74 as small as possible. An annular sealing ring 76 is located on the cylindrical wall 61 of the outer cylindrical portion 60 immediately adjacent to the end of the inner cylindrical wall 62 closest to the inner cylindrical portion 70 so as to provide support for the distal end of the cylindrical wall 76 thereof. The central shaft 80 and the hollow cylindrical shaft 81.

Figure 2:
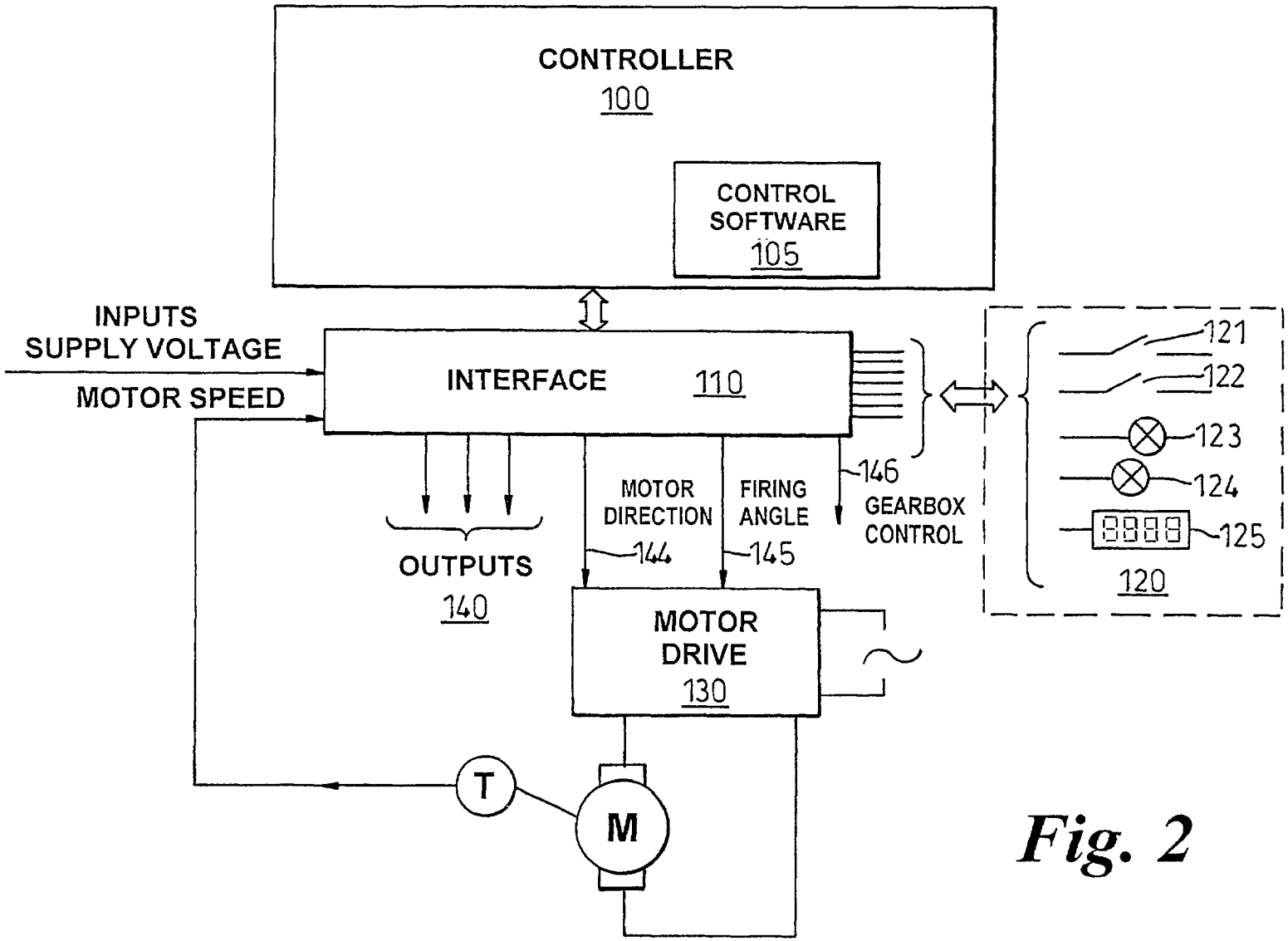
FIG. 2 shows a control system for the machine of FIG. 1.

FIG. 2 shows a control system for the machine 10. A controller 100 operates according to a control program stored on a non-volatile memory 105. The controller 100 is preferably implemented in the form of a microcontroller but other ways of implementing the controller, such as an implementation entirely in hardware, will be apparent to the reader and are intended to fall within the scope of this invention. An interface 110 interfaces the controller 100 to other parts of the machine 10. Sensors placed on the machine return input signals to the interface 110. The sensors include a sensor which monitors the value of the mains supply voltage and a tacho T which monitors the speed of the motor M. Motor M has an output drive shaft which is connected via a drive belt to a drive wheel and a gearbox to rotate the portions 60, 70 of the drum 50 about axis 85. The interface 110 also connects to a control panel 120 which is mounted on the front face of the machine 10. Control panel 120 includes switches 121, 122 (among others) by which a user can select a wash programme, wash temperature, spin speed, special functions etc., indicator lamps 123, 124 to confirm a user's selections or to indicate error conditions, and a display panel 125, such as an LCD display, on which text messages can be displayed to prompt the user or to inform the user of the progress of the machine during the wash cycle. Interface 110 receives inputs from the control panel to allow the controller 100 to determine what switch 121, 122 a user has pressed and outputs control signals to illuminate the indicator lamps 123, 124 and display 125. The interface also outputs a set of control signals 140 to control the operating state of various parts of the machine, such as the door lock, water inlet valves, and motor M. In a well-known manner, the control software 105 controls operation of the machine according to the inputs it receives and issues outputs 160 for controlling various parts of the machine.

The speed of motor M is controlled on the basis of an actual motor speed input to the interface and a speed demand, and an output signal 145 controls motor drive 130. Control signal 145 controls the firing angle of the triac (or other power switching device) in the motor drive circuit 130. Another output signal 144 controls the direction of rotation of the motor M and a further output signal 146 controls the state of the gearbox. The state of the gearbox determines whether the drum portions 60, 70 are rotated in unison or whether they are rotated relative to one another. Motor M can be used to drive both drum portions 60, 70 or two separate motors may be provided, one motor being used to drive each of the drum portions 60, 70.

In use, a user loads the drum 50 of the machine with laundry articles, selects an appropriate operating programme for the type of laundry, and starts the machine. The machine 10 then performs a laundry cycle. The laundry cycle comprises a number of stages:

- washing stages in which water and detergent are introduced to the interior of the tub 40 to produce a washing liquid, the heating of the washing liquid to a required temperature, and the rotation of the drum 50 about its axis within the tub 40 to agitate laundry contained within the drum 50, the draining of the washing liquid from the tub 40;
- rinse stages in which rinse water is introduced to the interior of the tub 40 and is extracted from the tub 40 by draining and slow spinning of the drum 50; and,
- spin stages in which the drum 50 is rotated very quickly about its axis 85 at speeds of up to 1600 rpm.

During the washing and rinsing stages, the drum 50 is driven at a relatively low speed (52 rpm). One of a plurality of different drum operations (defined in the table below) can be chosen: the normal action operation rotates the drum portions 60, 70 in unison whereas the counter rotation operation counter-rotates the drum portions 60, 70 with respect to one another for maximum agitation to laundry. The controller uses a particular drum operation according to the wash programme that was initially selected by a user, and will use the counter rotation operation wherever possible to minimise the length of the laundry cycle.

Each type of drum operation comprises a repeated sequence of four actions. For example, the 'Counter Rotation' operation performs: a first action which counter-rotates the drum portions 60, 70 with respect to one another for 13 s; a second action which rests for 6 s with no drum action; a third action which counter-rotates the drum portions 60, 70 with respect to one another for 13 s in the opposite direction to that used in action 1; and a fourth action which rests for 6 s with no drum action. Clearly, any of the parameters of the drum operations defined here could be varied as appropriate.

| Type of drum operation | Action no. | Duration (s) | Drum speed (rpm) |
|---|---|---|---|
| Counter Rotation | 1 | 10 | 52 |
| Normal | 2 | 32 | 0 |
| (CRN) | 3 | 10 | −52 |
| | 4 | 32 | 0 |
| Normal Action | 1 | 11 | 52 |
| (NA) | 2 | 5 | 0 |
| | 3 | 11 | −52 |
| | 4 | 5 | 0 |

Figure 3A:
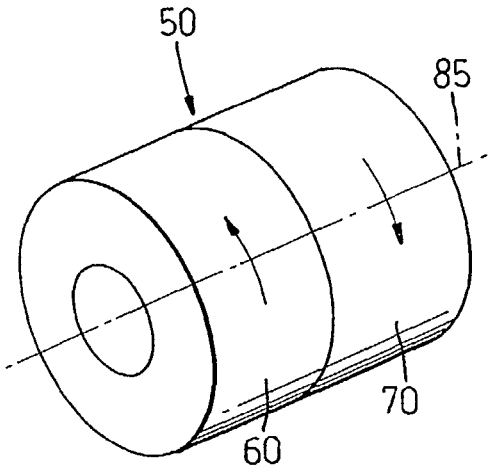
FIGS. 3A–3C shows operation of the drum of the machine of FIG. 1 during counter-rotating operation.
Figure 4A:
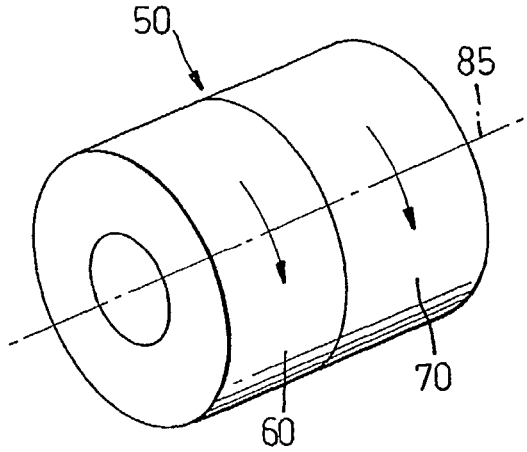
FIGS. 4A–4C shows operation of the drum of the machine of FIG. 1 during normal operation; and, FIG. 5 is a flow diagram of a method performed by the control system of FIG. 2.
Figure 3B:
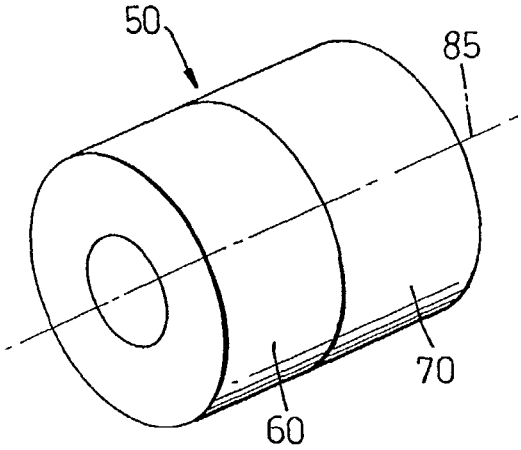
Figure 4B:
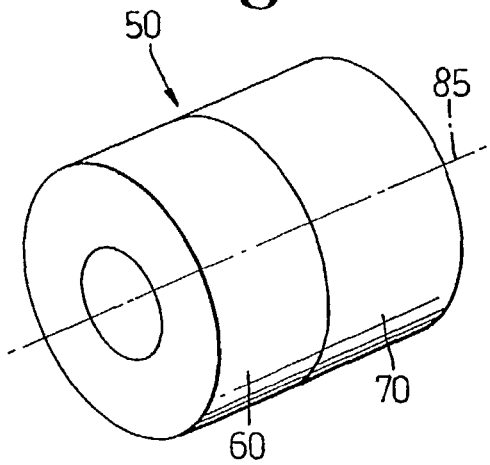
Figure 3C:
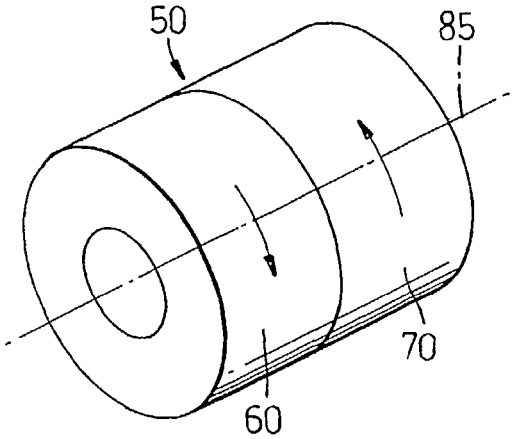
Figure 4C:
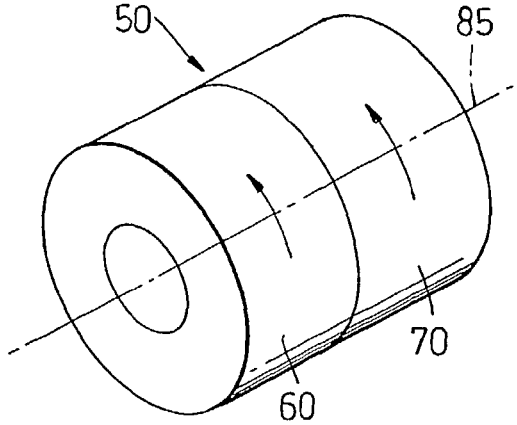

FIGS. 3A–3C illustrate actions numbers 1–3 for the counter-rotating drum operation where the drum portions 50, 60 firstly rotate in opposite directions (FIG. 3A), then rest (FIG. 3B), then rotate in opposite directions (FIG. 3C) with each drum portion 60, 70 rotating in a different direction to that in FIG. 3A and finally rest (not shown.) FIGS. 4A–4C illustrate actions for the normal drum operation where the drum portions 60, 70 firstly rotate in unison in the same direction (FIG. 4A), then rest (FIG. 4B), then rotate in unison (FIG. 4C) in the opposite direction to that in FIG. 4A and finally rest (not shown.)

Figure 5:
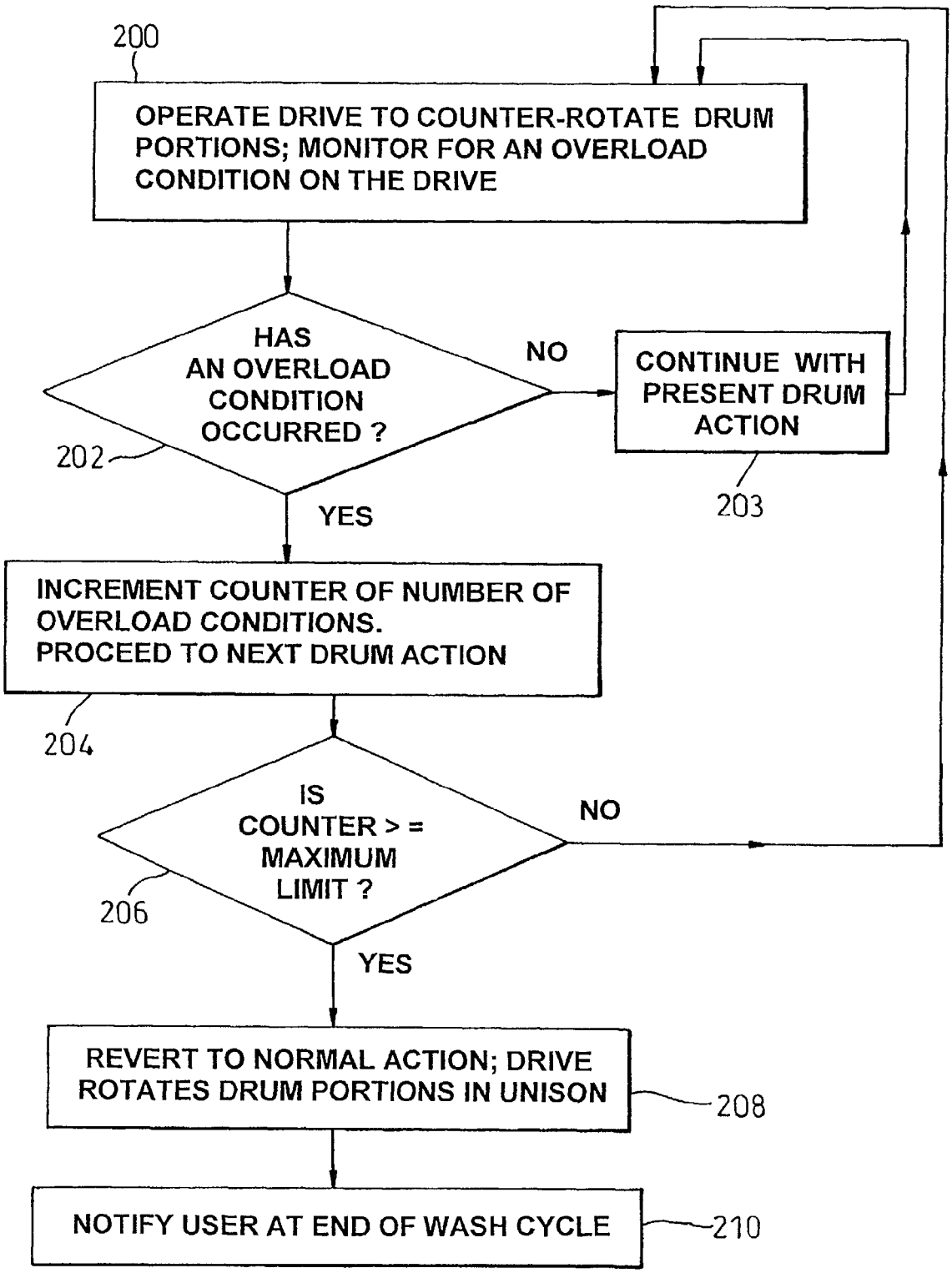

FIG. 5 is a flow diagram of a method performed by the controller 100 to control operation of the machine 10 during the washing and rinsing stages. Firstly, at step 200, the controller controls the drive in a manner which causes relative rotation between the drum portions 60, 70. During this time, the controller 100 monitors for an overload condition on the drive.

The method for determining whether the machine is overloaded will now be described. At each point in the machine's operation, there will be a demand for the machine to operate at a particular speed, e.g. during a wash cycle this will be to operate at 52 rpm. The controller 100 stores (in software 105) a table which indicates what maximum firing angle is allowed for a given demand in motor speed and a given supply voltage. This maximum firing angle is based on a desired maximum torque which the drive can safely work to without damaging or reducing the life of the machine. Controller 100 monitors the inputs representative of the actual motor speed, the value of the supply voltage and also the demand speed at that time, and derives a required firing angle. If the required firing angle exceeds the maximum allowed for the current parameters then the drive is deemed to be overloaded.

As previously explained, an overload may be caused by a user over-filling the drum with laundry or by placing rigid articles in the drum. Step 202 determines whether an overload condition has occurred. If an overload condition has not occurred the controller simply causes the drive to continue operating in the same manner. If an overload condition has occurred a counter is incremented to track the total number of overload conditions. The controller aborts the current drum action and proceeds directly to the next action; for example, the controller aborts drum action number 1 where it counter rotates the drum portions and proceeds directly to drum action numbers 2 and 3 where it rests and then counter rotates the drum portions in the opposite direction. Aborting the current drum action prevents any damage to the machine and the next action, which is usually an opposite action to the first, helps to redistribute the laundry.

At step 206 the controller determines whether the counter has reached the maximum limit for overloads. The limit can be set at a number such as three. If the counter has not reached the limiting number, it continues using a counter-rotating drum operation. If the counter has reached the limiting number, it proceeds to step 208 and controls the machine in a way that avoids use of the counter-rotating drum operation. Avoiding the use of counter-rotation reduces wash performance. At the end of the wash cycle, or at the time of reaching the limiting number of overload conditions, the machine notifies the user that they have overloaded their machine. Thus, the user will be trained to better judge the quantity and type of laundry that they place in the machine on future occasions. The controller can control a display on the control panel of the machine to display a text message or it can illuminate a labelled indicator lamp. The reason for having a counter of the number of overload conditions rather than simply reverting to normal action after the occurrence of one overload condition is that the continual redistribution of laundry within the drum 50 can occasionally result in the laundry forming in a manner that will cause an overload condition on the drive when the drive attempts to counter-rotate the drum portions 60, 70. Resorting to normal action after only one overload condition will unnecessarily reduce the performance of the laundry cycle. However, should three (or whatever other limiting number is chosen) overload conditions occur during a wash cycle, this is indicative of the drum being loaded with too much laundry or inappropriate items.

At step 208, in addition to simply reverting to normal action, the controller can increase the length of that stage of the washing cycle to compensate for the change from counter-rotation to normal action of the drum.

Variations to the described embodiments are intended to fall within the scope of this invention. For example, the drum is not limited to having two rotatable portions but can comprise three or more adjacent rotatable portions.

The invention claimed is:

1. A method of operating a laundry appliance comprising a drum for receiving a load of articles to be laundered, the drum comprising at least two rotatable drum portions and a drive capable of rotating the drum so as to cause relative rotation between adjacent rotatable drum portions, a sensor sensing a speed of the drum and producing an output indicative of the speed of the drum, and a controller for monitoring and controlling operation of the appliance based on the sensor output, the method comprising:

causing the drive to rotate the drum portions relative to one another according to a predetermined sequence of drum actions for a period of time, determining when there is an overload condition on the drive during the period of time and, in the event of an overload condition, causing the drive to abort the drum action of the predetermined sequence in which the overload condition is detected and to begin the next drum action in the predetermined sequence so as to redistribute the articles and eliminate the overload condition.

2. A laundry appliance, comprising:

a drum for receiving a load of articles to be laundered, comprising at least two rotatable drum portions and a drive capable of rotating the drum so as to cause relative rotation between adjacent rotatable drum portions, a sensor sensing a speed of the drum and producing an output indicative of an actual speed of the drum, and a controller for monitoring and controlling operation of the appliance based on the sensor output, the controller being configured to cause the drive to rotate the drum portions relative to one another according to a predetermined sequence of drum actions for a period of time, to determine when there is an overload condition on the drive during the period of time and, in the event the controller determines the existence of an overload condition, to cause the drive to abort the drum action of the predetermined sequence in which the overload condition is detected and to begin the next drum action in the predetermined sequence so as to redistribute the articles and eliminate the overload condition.

3. An appliance according to claim 2, wherein the controller is configured to monitor the number of times an overload condition occurs and, in the event of an overload condition occurring a predetermined number of times, to cause the drive to operate without relative rotation between the portions.

4. An appliance according to claim 2, wherein, in the event of an overload condition, the controller is configured to increase the length of a laundering cycle.

5. An appliance according to claim 2, further comprising a user interface, the controller being configured to issue a signal indicating the existence of an overload condition to a user of the appliance via the user interface when an overload condition occurs.

6. An appliance according to claim 5, wherein the controller is configured to issue the signal at the end of an operating cycle of the appliance.

7. An appliance according to claim 2, wherein the controller is configured to determine a required speed at which the drum is to rotate, to monitor the actual speed at which the drum is rotating and to determine whether there is an overload condition is based on a difference between the required speed and the actual speed.

8. An appliance according to claim 7, wherein the drive further comprises a switch for switching a power supply to a motor which rotates the drum, and wherein the controller is configured to determine a period during which the switch should remain on for a given speed difference, and if the determined period exceeds a limit, the drive is deemed to be in an overload condition.

9. An appliance according to claim 2 in the form of a washing machine.

10. A laundry appliance, comprising:

a drum for receiving a load of articles to be laundered, comprising at least two rotatable drum portions and a drive capable of rotating the drum so as to cause relative rotation between adjacent rotatable drum portions, a sensor for monitoring a supply voltage and providing an output indicative of the supply voltage to the appliance, and a controller for monitoring and controlling operation of the appliance, wherein the controller is configured to monitor the supply voltage to the appliance output by the sensor and to determine whether there is an overload condition based on the monitored supply voltage, and the controller is configured to cause the drive to rotate the drum portions relative to one another according to a predetermined sequence of drum actions for a period of time, to determine when there is an overload condition on the drive during the period of time and, in the event the controller determines the existence of an overload condition, to cause the drive to abort the drum action of the predetermined sequence in which the overload condition is detected and to begin the next drum action in the predetermined sequence so as to redistribute the articles and eliminate the overload condition.

11. A controller for a laundry appliance comprising a drum for receiving a load of articles to be laundered, the drum comprising at least two rotatable drum portions, a drive capable of rotating the drum so as to cause relative rotation between adjacent rotatable drum portions, and a sensor sensing a speed of the drum and producing an output indicative of the speed of the drum, the controller comprising a unit for monitoring and controlling operation of the appliance based on the sensor output, the controller being configured to cause the drive to rotate the drum portions relative to one another according to a predetermined sequence of drum actions for a period of time, to determine when there is an overload condition during this period and, in the event of an overload condition, to cause the drive to abort the drum action of the predetermined sequence in which the overload condition is detected and to begin the next drum action in the predetermined sequence so as to redistribute the articles and eliminate the overload condition.

* * * * *